United States Patent [19]

Fujiwara et al.

[11] 4,063,203

[45] Dec. 13, 1977

[54] REED SWITCH

[75] Inventors: Kazushi Fujiwara; Mituyuki Asai; Susumu Aoki, all of Kitakyushu, Japan

[73] Assignee: Kabushiki Kaisha Yaskawa Denki Seisakusho, Japan

[21] Appl. No.: 674,563

[22] Filed: Apr. 7, 1976

[30] Foreign Application Priority Data

Apr. 15, 1975 Japan ..... 50-45590

[51] Int. Cl.[2] ..... H01H 51/28

[52] U.S. Cl. ..... 335/154; 335/151

[58] Field of Search ..... 335/154, 151, 152, 153

[56] References Cited

U.S. PATENT DOCUMENTS

| | | | |
|---|---|---|---|
| 3,327,262 | 6/1967 | Bongard et al. | 335/154 |
| 3,349,352 | 10/1967 | Zandt | 335/154 |
| 3,356,974 | 12/1967 | Funke | 335/154 |
| 3,579,158 | 5/1971 | Kutyla | 335/151 |
| 3,586,809 | 6/1971 | Santi | 335/154 |

*Primary Examiner*—Harold Broome

*Attorney, Agent, or Firm*—Fitzpatrick, Cella, Harper & Scinto

[57] ABSTRACT

In a reed switch comprising an envelope, first and second stationary terminals, and an armature supported elastically on the second stationary terminals in such a manner that the innermost end portion of the second stationary terminal and one end portion of the armature are opposite to each other with a magnetic gap, each of the one end portion of the armature and the innermost end portion of the second stationary terminal is larger in sectional area than the other portion thereof, thereby to decrease the magnetic resistance of the magnetic gap and to increase the closing power of the switch. According to another aspect of the invention, the reed switch has a back stop for detaining the armature when the switch is opened.

2 Claims, 13 Drawing Figures

REED SWITCH

BACKGROUND OF THE INVENTION

This invention relates to reed switches, and more particularly to all types of reed switches such as ordinary reed switches having two contacts or single-pole single-throw reed switches, transfer type reed switches or single-pole double-throw reed switches, and reed switches having various type back stoppers.

Heretofore, in such reed switches, and especially in those having large capacity, a stationary terminal and an armature are connected by a leaf spring to get a suitable spring force without decreasing magnetic force. However, in the reed switches thus organized, inevitably there is an air gap between the stationary terminal and the armature, which leads not only to increase of the operating ampere turn of the read switch but also to fluctuation of the operating ampere-turn itself.

SUMMARY OF THE INVENTION

Accordingly, an object of this invention is to overcome the above-described difficulty accompanying conventional reed switches.

More specifically, an object of the invention is to provide a reed switch in which the magnetic resistance of an air gap between a stationary terminal and an armature connected thereto is substantially decreased, and the closing power of the switch is increased, thereby to reduce the operating ampere-turn of the switch.

Another object of the invention is to provide a reed switch which is provided with a back stop for detaining its spring-loaded armature.

Another object of the invention is to provide a reed switch which is positive in operation and high in reliability.

The foregoing objects and other objects of the invention have been achieved by the provision of a reed switch comprising an envelope of non-magnetic material, first and second stationary terminals provided at both ends of the envelope in such a manner that each of the terminals is penetrated into the envelope to have internal and external terminal portions, a stationary contact provided on the internal terminal portion of the second stationary terminal, a supporting member of electrically conductive elastic material supported at one end on the internal terminal portion of the second stationary terminal and extended toward the first stationary terminal, and a movable member of magnetic material provided with a movable contact which is brought in contact with the stationary contact, and supported by the elastic supporting member in such a manner that the innermost end portion of the second stationary terminal and one end portion of the movable member are directly opposite to each other with a magnetic gap therebetween, the one end portion of the movable member and the innermost end portion of the second stationary terminal each being larger in sectional area than the other portion thereof, and further comprising a back stop member for detaining the armature.

The manner in which the foregoing and other objects are achieved by this invention will become more apparent from the following detailed description and the appended claims when read in conjunction with the accompanying drawings.

DETAILED DESCRIPTION OF THE INVENTION

Figure 1:
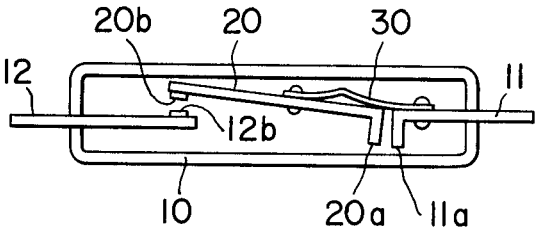
FIGS. 1, 2 and 3 are side elevations, with envelopes sectioned, illustrating basic examples of a reed switch according to this invention.
Figure 2:
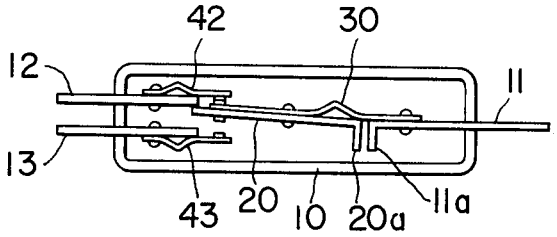
Figure 3:
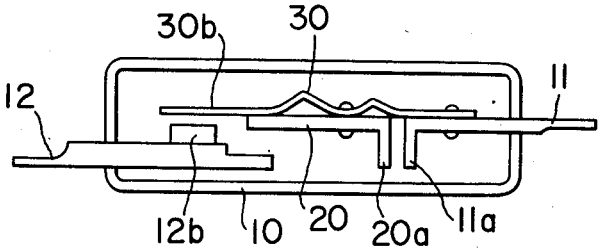

Basic examples of this invention are shown in FIGS. 1 – 3, in which like parts are designated by like reference characters.

A first basic example of a reed switch according to the invention, as shown in FIG. 1, comprises a non-magnetic material such as sealed envelope 10 made of glass or ceramic, two stationary terminals 11 and 12 penetrated into the envelope 10 each having internal and external terminal portions, and a movable member or an armature 20 elastically supported by the internal terminal portion of the stationary terminal 11 through an elastic supporting member or a leaf spring 30.

One end portion of the armature 20 and that of the terminal 11 opposite to each other are extended downward to form bent portions 20*a* and 11*a*, respectively.

Contacts 20*b* and 12*b* are provided on the other end portion of the armature 20 and on the internal terminal portion of the stationary terminal 12, respectively, in such a manner that they are opposite to each other.

FIG. 2 shows a second basic example of the reed switch according to the invention. This is a transfer type reed switch which is similar in construction to the reed switch shown in FIG. 1 except that two stationary contacts are provided for one armature. More specifically, similarly as in the reed switch shown in FIG. 1, the armature 20 is elastically supported through a leaf spring 30 by a stationary terminal 11 provided on one end of an envelope 10, that is, the armature 20 is connected through the leaf spring 30 to the internal terminal portion of the stationary terminal 11 which is extended into the envelope 10, and the internal terminal portion of the terminal 11 and one end portion of the armature 20 opposite thereto are extended downward to form bent portions 20*a* and 11*a*, respectively. However, the reed switch shown in FIG. 2 has two stationary terminals 12 and 13 on the other end of the envelope 10 which are also penetrated into the envelope, and leaf spring 42 and 43 with contacts connected to the internal terminal portions of the stationary terminals 12 and 13 in such a manner that the contacts of the armature are opposite to the contacts of the stationary terminals 12 and 13.

A third basic example of the reed switch according to this invention, as shown in FIG. 3, is somewhat similarly to the reed switch shown in FIG. 1, but it is different in that a leaf spring 30 has an end portion 30*b* serving as a movable contact and is extended beyond an armature 20 which, when the switch is tripped, performs a hammering action. In this example, the end portion 30*b* of the leaf spring 30 serves as a movable contact as was described; however, it goes without saying that a contact like the contact 20*b* in FIG. 1 may be provided at the end portion 30*b* of the leaf spring 30.

It should be noted that in the basic examples described above the armature and the stationary terminal connected thereto have the bent portions, respectively, so that one end portion of the armature opposite to that of the stationary terminal supporting the armature has a larger area than the other portions thereof, and similarly as in the case of the armature the one end portion of the stationary terminal has a larger area than the other portions of the same.

Thus, according to this invention, the magnetic resistance of the air gap between the two opposite end portions of the armature 20 and the stationary terminal 11 can be substantially reduced by the provision of the bent portions 20*a* and 11*a* described above, and the bent portions form a kind of hinge magnet having its hinge center at a point on the leaf spring 30, which leads to increase of the closing power of the reed switch. As a result, the operating ampere-turn of the reed switch is reduced.

Figure 4:
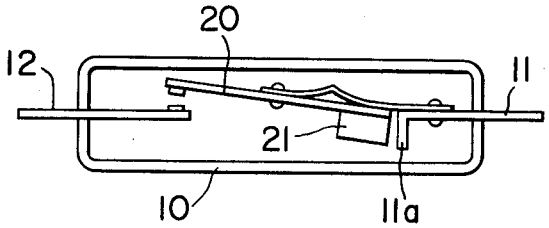
FIGS. 4 and 5 are explanatory views illustrating modifications of the reed switch according to the invention.

One modification of the reed switch according to the invention, as illustrated in FIG. 4, is similar to the reed switch shown in FIG. 1 except that the armature 20 has a block 21 of magnetic material instead of the bent portion described before. In this example the armature 20 has the magnetic block 21, however, the reed switch may be so designed that the bent portion 11*a* of the stationary terminal 11 is replaced by such block, or that both of the armature 20 and the terminal 11 have such blocks at the opposite end portions thereof, respectively.

Figure 5:
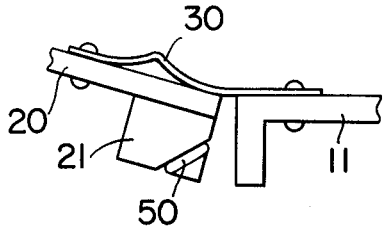

If a seizing coil 50 is provided on a part of the block 21 as shown in FIG. 5, the a.c. operation of the reed switch can be effected.

According to another aspect of this invention, reed switches having a back stop means or a back stop mechanism for detaining an armature elastically supported on a stationary terminal by a leaf spring are provided.

Figure 6A:
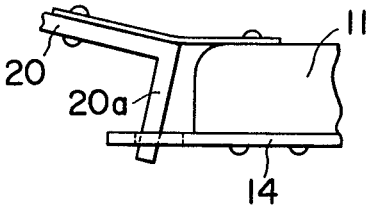
FIG. 6*a* is a side view showing one example of a back stop mechanism employed in the reed switch according to the invention.
Figure 6B:
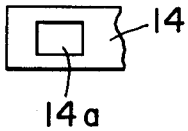
FIG. 6*b* is a plan view showing a back stop member of the back stop mechanism in FIG. 6*a;*

In one example of the back stop mechanism of the reed switch according to this invention, as shown in FIGS. 6*a* and 6*b*, a back stop member 14 with a slot 14*a* is mounted on the internal terminal portion of the stationary terminal 11 described before. The bent portion 20*a* of the armature 20 is inserted into the slot 14*a* so that the moving range of the armature 20 is limited by the slot 14*a*, that is, the armature 20 elastically supported is detained by the slot 14*a*. The movable distance of the armature 20 can be adjusted by moving the back stop member 14 in the longitudinal direction of the reed switch.

Figure 7:
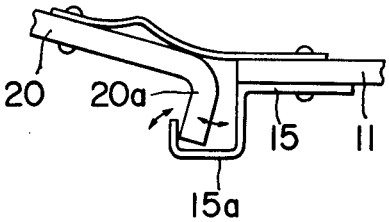
FIGS. 7, 8, 9 and 10, are side views showing other examples of the back stop mechanism employed in the reed switch according to the invention.

Another example of the back stop mechanism is shown in FIG. 7, in which the movement of the armature 20 is limited by the end portion 15*a*, bent in the form of a letter "U", of a back stop member 15. More specifically, the bent portion 20*a* of the armature 20 is placed in the channel which is formed by the U-shaped end portion 15*a* of the back stop member 15 mounted on the internal terminal portion of the stationary terminal 11. Accordingly, the movement of the bent portion 20*a* and accordingly the movement of the armature 20 is limited by the channel of the back stop member 15. The limit in movement of the armature 20 can be changed by moving the back stop member 15 in the longitudinal direction of the reed switch or by changing the bend angles of the bent portion 20*a* of the armature 20 and the bent portion 15*a* of the back stop member 15.

Figure 8:
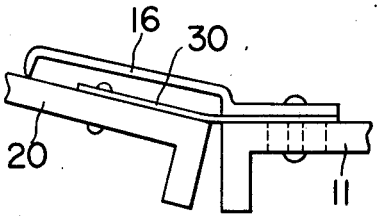

Another example of the back stop mechanism, as shown in FIG. 8, comprises a back stop member 16 mounted on the stationary terminal 11 and having a portion extended over the armature 20 which is connected through the leaf spring 30 to the stationary terminal 11. The portion of the back stop member 16 extended over the armature 20 serves to stop the armature in place which tends to move upward by the elastic force of the leaf spring 30. The adjustment of the back stop mechanism can be achieved by bending the portion of the back stop member 16 extended over the armature or by moving the back stop member in the longitudinal direction of the reed switch.

Figure 9:
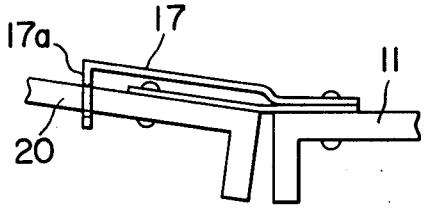

Another example of the back stop mechanism according to the invention is shown in FIG. 9, being one modification of the back stop mechanism shown in FIG. 8. In this example also, a back stop member 17 mounted on a stationary terminal 11 has a portion extended over an armature connected through a leaf spring 30 thereto. The portion of the member 17 extended over the armature 20 is bent toward the armature 20 to form a bent portion 17*a*. The bent portion 17*a* thus formed is provided with a slot into which the armature is inserted so that the movement of the armature 20 is limited. The adjustment of this detaining mechanism can be achieved in a manner similar to those described above.

Figure 10:
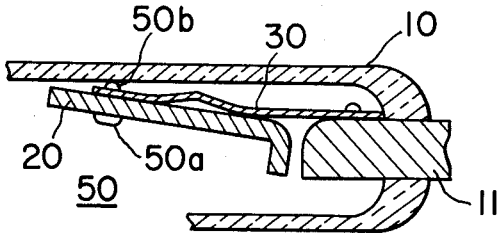

Another example of the back stop mechanism, as shown in FIG. 10, is simpler than those described before. In this back stop mechanism, a rivet 50 used for connecting the leaf spring 30 to the armature 20 is utilized. More specifically, the head 50*a* of the rivet 50 is employed as the movable contact, and the other end portion 50*b* protruded and caulked over the leaf spring 30 is adapted to abut against the inner wall of the envelope 10 thereby to stop the movement of the armature 20. In this case, the inner wall of the envelope serves as the back stop member described above.

One example of the reed switch having both the arrangement of decreasing the magnetic resistance and the stopper mechanism will be described in detail with reference to FIG. 11.

The reed switch comprises an envelope 1 of glass or ceramic, and first and second stationary terminals 2 and 3 respectively provided at both ends of the envelope 1. More specifically, the first and second stationary terminals 2 and 3 are penetrated into the envelope 1. The portions of the terminals 2 and 3 inside the envelope will be referred to as "internal terminal portions 2*b* and 3*b*", respectively, and similarly the portions outside the envelope will be referred to as external terminal portions 2*a* and 3*a* respectively, hereinafter.

An electrically conductive leaf spring 4 is fixed at one end to the portion, adjacent to the end of the envelope 1, of the internal terminal portion 2*b*, and is extended toward the center of the envelope. The leaf spring 4 is provided with a contact 4*a* at the other end, and has a bent portion 4*b* protruded downward at the middle portion so as to abut against the internal terminal portion 2*b*.

A movable member or an armature 6 of magnetic material is elastically connected through a supporting member or a leaf spring 7 fixed at one end on the armature 20 to the internal terminal portion 3b. One end portion, opposite to the internal terminal portion 3b, of the armature 6 is bent downward to form a bent portion 6a. The other end portion of the armature 6 is provided with a contact 6b which is opposite to the contact 4a of the first stationary terminal 2. The leaf spring 7 has a bent portion 7a protruded upward in the middle portion.

An "L"-shaped stopper member 8 is mounted on the internal terminal portion 3b so as to engage with the bent portion 6a of the armature 6, and if necessary, the upper surface of the end portion of the first internal terminal 2c and opposite surface of the end portion of the armature 6c are coated with nonmagnetic and hard material such as tungsten, molybdenum and other materials to obtain positive release ampere-turn and long life.

The operation of the reed switch thus organized will now be described.

Figure 11:
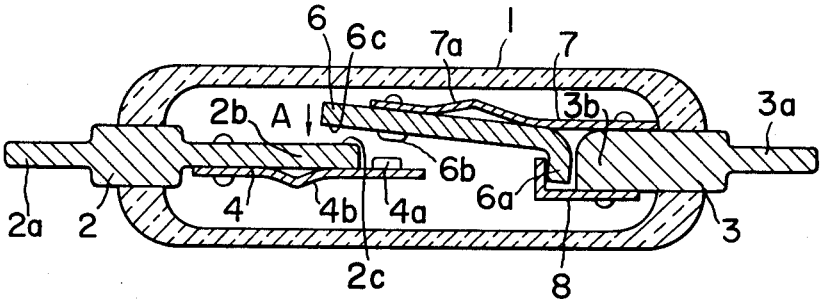
FIG. 11 is a sectional view showing one typical example of the reed switch according to the invention.

If, under the conditions that the reed switch is open as shown in FIG. 11, a coil (not shown) wound around the envelope 1 is excited, the flux of the coil forms a magnetic circuit passing the second stationary terminal 3, the bent portion 6a confronting the stationary terminal 3, the armature 6, and the first stationary terminal 2.

Figure 12:
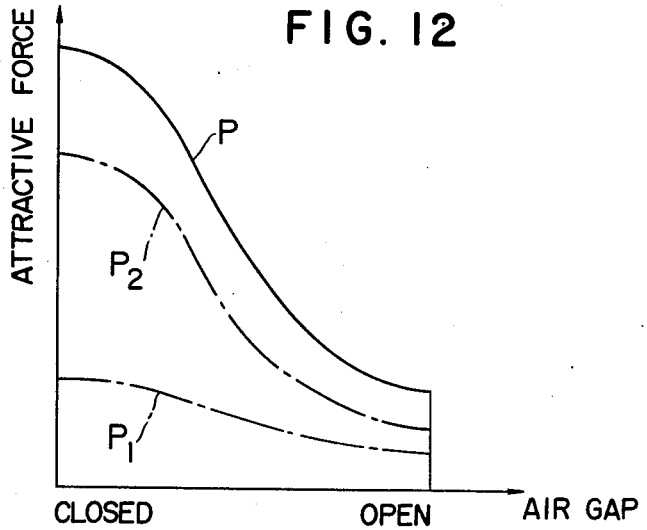
FIG. 12 is a graphical representation indicating magnetic attraction forces generated in the reed switch shown in FIG. 11.

Then, magnetic attractive forces $P_1$ and $P_2$ as indicated in FIG. 12 are generated between the bent portion 6a and the second internal terminal portion 3b, and between the armature 6 and the first internal terminal portion 2b, respectively. The armature 6 is moved by the sum P of the magnetic attractive forces $P_1$ and $P_2$, that is, the armature is moved in the direction of the arrow A (FIG. 11) against the elasticity of the leaf spring 7 until the armature 6 contacts the internal terminal portion 2b. In this operation, as the armature 6 is moved downward, first the contact 6b of the armature 6 is brought in contact with the contact 4a on the leaf spring 4, and as armature is further moved downward a repulsive force is stored in the leaf spring 4 since the leaf spring 4 is swung downward by the armature 6, and finally the armature is brought in contact with the internal terminal portion 2b. Thus, an electrical loop circuit is completed through the reed switch.

On the other hand, when the coil is deenergized, the armature 6 is moved in the direction opposite to the direction 7 arrow A with the aid of the restoring forces or elasticity of the leaf springs 4 and 7, and is then stopped by the back stop member 8.

More specifically, upon deenergization of the coil, the leaf spring 4 which has been swung downward is swung back to stop suddenly by the internal terminal portion 2b and a repulsive force between the contacts 4a and 6b is caused by the striking action of the leaf spring 4. As a result, the leaf spring 4 and accordingly the contact 4a are maintained stopped, being kept remote from the contact 6b of the armature 6. As the armature is moved upward or in the direction opposite to the arrow A by the elasticity of the leaf spring 7, the bent portion 6a of the armature 6 is caused to abut against the stopper member 8 whereby the armature is detained by the latter. Thus, the electrical loop circuit is opened.

As is apparent from the above descriptions, according to this invention, one end portion of the armature has a larger area than the other portions of the same, and one end portion, opposite to the former, of the stationary terminal supporting the armature is also made to have a larger area than the other portions, whereby reed switches of small ampere-turn, positive operation, and high reliability are provided.

What is claimed is:

1. A reed switch comprising:

a. a protective envelope of non-magnetic material;

b. a first stationary terminal of magnetic material provided at one end of said envelope in such a manner that said first stationary terminal is penetrated into said envelope to have internal and external terminal portions, said first stationary terminal being fixed and sealed at said one end of said envelope;

c. a second stationary terminal of magnetic material provided at the other end of said envelope in such a manner that said second stationary terminal is penetrated into said envelope to have internal and external terminal portions, said first stationary terminal being fixed and sealed at said other end of said envelope;

d. a resilient contact member support, at one end, on the internal terminal portion of said first stationary terminal and extended along said internal terminal portion of said first stationary terminal, said resilient contact member have a contact on the other end thereof;

e. a supporting member of electrically conductive elastic material supported at one end on the internal terminal portion of said second stationary terminal and extended toward said first stationary terminal;

f. a movable member of magnetic material extended in parallel with said supporting member, one end portion of said movable member having a first end face which is larger in sectional area than the other portion of said movable member and which is opposed to a second end face of the internal terminal portion of said second stationary terminal, said second end face being larger in sectional area than the other portion of said second stationary terminal, the other end portion of said movable member being opposed to the internal terminal portion of said first stationary terminal with a magnetic gap therebetween; and g. a movable contact having a movable contact surface which effects on-off operation with said stationary contact, said movable contact fixedly securing said movable member to said supporting member.

2. A reed switch as claimed in claim 1, in which said movable member is in the form of the character "L".

* * * * *